United States Patent [19]

Kawai et al.

[11] 3,942,422

[45] Mar. 9, 1976

[54] ROOF VENTILATOR

[75] Inventors: Yuzo Kawai; Hajime Kawai; Ryoyu Hachisu, all of Nara, Japan

[73] Assignee: Suiden Kabushiki Kaisha, Osaka, Japan

[22] Filed: June 11, 1974

[21] Appl. No.: 478,375

[30] Foreign Application Priority Data

June 19, 1973 Japan ..... 48-72529

[52] U.S. Cl. ..... 98/116; 137/53; 137/601; 415/125

[51] Int. Cl.[2] ..... F04D 25/08; F04D 25/14

[58] Field of Search ..... 98/116; 415/125; 137/601, 137/53

[56] References Cited

UNITED STATES PATENTS

| | | | |
|---|---|---|---|
| 2,551,004 | 5/1951 | Johnson | 98/116 |
| 2,738,124 | 3/1956 | Rosenberg | 98/116 |
| 3,589,267 | 6/1971 | Hosono et al. | 98/116 |

FOREIGN PATENTS OR APPLICATIONS

| | | | |
|---|---|---|---|
| 814,398 | 6/1959 | United Kingdom | 98/116 |

*Primary Examiner*—William F. O'Dea
*Assistant Examiner*—Ronald C. Capossela
*Attorney, Agent, or Firm*—Stewart and Kolasch, Ltd.

[57] ABSTRACT

A roof ventilator comprising a pipe provided with an opening therein, a shutter means adapted to be raised above or lowered over said opening, a supporting arm associated with a rotating shaft which is rotatably disposed within said pipe, a fan means housed in said pipe below said shutter means and attached to said shaft, means for rotating said shaft and the fan associated therewith, said shutter means being supported on said supporting arm by two pairs of foldable arms, each pair of arms being pivotally connected to each other and to the terminating top end portion of said supporting arm at one end and to the shutter means at the other end so that a unitary upward movement of said pairs of foldable arms and said shutter means is achieved by the rotation of the fan means disposed therebelow.

7 Claims, 4 Drawing Figures

Fig. 1
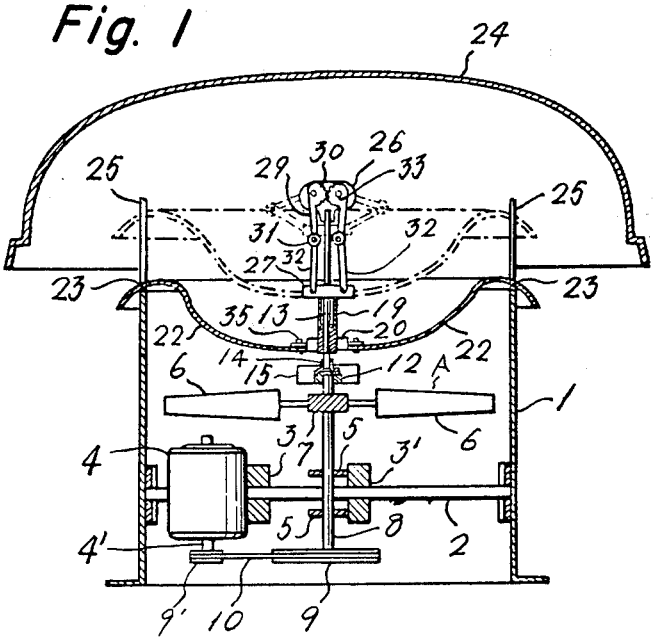
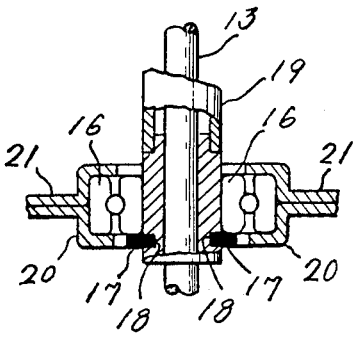
Fig. 3
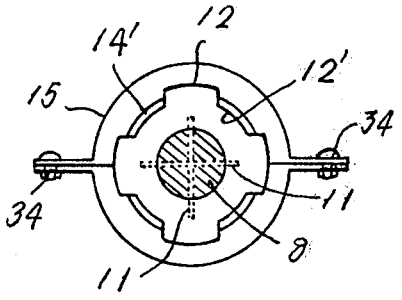
Fig. 4

ROOF VENTILATOR

BACKGROUND AND SUMMARY OF THE INVENTION

The present invention relates to a roof ventilator for exhausting air from and taking air into a room. More particularly, the present invention relates to a roof ventilator adapted for use in locations where a desired temperature must be constantly maintained, such as for example, a laboratory or an agricultural warehouse.

In the locations mentioned above, the maintenance of a constant temperature is required because otherwise, detrimental effects will be produced. In conventional ventilating systems, problems have been encountered in either admitting unexpected cold or warm outside air into rooms, or in allowing the inside air to escape therefrom. In order to overcome these problems, a number of proposals have been made, including a ventilator having a floating shutter which operates against the opening in the piping. According to this device, when the ventilator is in operation, the shutter rises up due to air pressure produced by a power driven fan, thereby creating a gap between the hood and the opening in the pipe. When the operation of the ventilator is stopped, the shutter moves downwards due to gravity to ensure the closure of the pipe. However, it has been proven that the upward movement of the shutter is prevented by the pneumatic repercussion under the hood, and also by the intake or exhaust air whirling thereunder which produces an unstable movement of the shutter. In addition, the shutter is subjected to vibrations, which causes disagreeable noises. Furthermore, the raising of the shutter, even if successfully achieved, is possible only when air is exhausted from the building through the pipe.

An object of the present invention is to avoid the prior art disadvantages found in roof ventilators used for introducing air into and removing air from a specific location.

Another object of the present invention is to provide a roof ventilator containing a shutter which is capable of preventing air from passing therethrough when the ventilator is not in operation, thereby maintaining a desired constant room temperature.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, a floating shutter is carried by foldable supporters which fold in the upward direction due to the centrifugal action produced when a ventilating fan is driven in either direction for taking in or exhausting air through the device. The movement of the shutter is facilitated by a gearing arrangement associated with the foldable supporters. Accordingly, when the shutter is forced in the upward direction, or lowered as a result of gravity, the movement of the shutter is ensured without producing any substantial noise and with little chance of failure.

BRIEF DESCRIPTION OF THE DRAWINGS

The present invention will become more fully understood from the detailed description given hereinbelow and the accompanying drawings which are given by way of illustration only, and thus are not limitative of the present invention and wherein, FIG. 1 is a vertical section through a roof ventilator according to the present invention;

FIG. 3 is a fragmentary cross-section on an enlarged scale illustrating the connection of the shutter to the supporting rod, and FIG. 4 is a bottom view on an enlarged scale illustrating the connection of the shutter and supporting rod to the rotating shaft of the fan.

DESCRIPTION OF THE PREFERRED EMBODIMENTS

Figure 2:
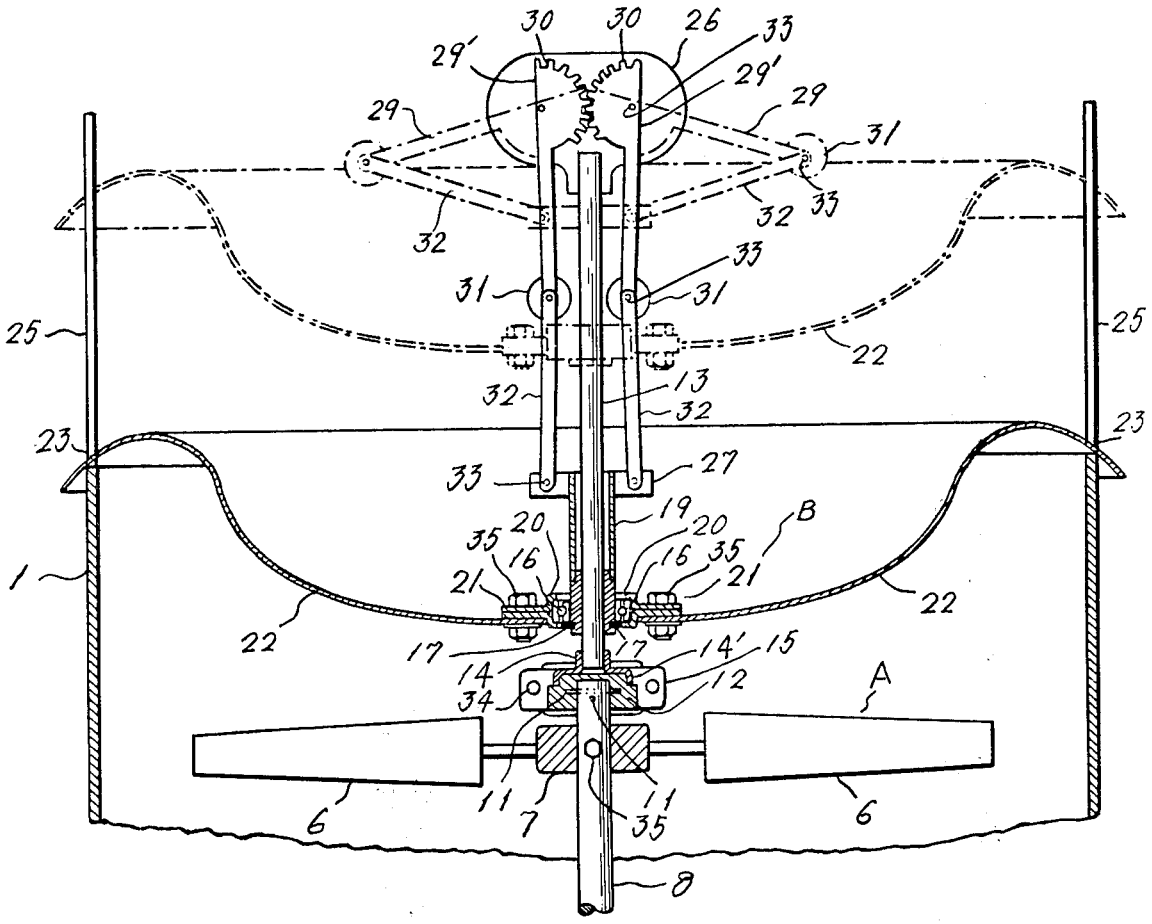
FIG. 2 is a vertical section on an enlarged scale of the main part of the roof ventilator illustrated in FIG. 1.

Referring now to the drawings wherein like reference numerals are used throughout the various views to indicate identical elements, the roof ventilator of the present invention comprises a ventilation pipe 1 having a reversible electric motor 4 mounted therein for driving a fan wheel A. In the preferred embodiment which is illustrated, a pair of supporting beams 2 extend across the pipe 1, said supporting beams containing supporting rests 3 and 3'. On the supporting rest 3, the motor 4 is mounted, and on the other supporting rest 3' a pair of bearings 5 are provided, said bearings supporting a rotating shaft 8 which in turn supports the fan wheel A through the use of a boss 7. Element 6 indicates the individual vanes of the fan wheel. The rotating shaft 8 is connected to the motor by means of pulleys 9, 9' and a belt 10. Element 4' indicates the spindle of the motor 4. The motor can be rotated in either direction depending upon the need for admitting or exhausting air.

A shutter 22 having the shape of a concave plate is provided with a hub portion B, and is designed to ensure its closure against the opening provided in the pipe 1. In addition, the shutter 22 is provided with an appropriate number of apertures 23 in the rim portion thereof, through which guide rods 25 are passed, said guiding rods extending upwardly from the terminating end portion of the pipe wall 1. The hub portion B includes a bearing 16 housed in a bearing case 20, which is provided with an extended portion 21 so as to provide a connecting base with the shutter 22. In the embodiment illustrated, the shutter 22 is fastened to the bearing case 20 by means of a bolt and nut 35. In the bearing 16 a sleeve 19 is passed therethrough, said sleeve being provided with a ring-shaped flange 17 disposed in the lower portion thereof for the hub portion B to rest upon as illustrated in FIG. 3. As is evident from the above-description, the sleeve 19 is rotated in the bearing 16 independent of the hub portion B of the shutter 22.

A supporting rod 13 passes through the sleeve 17, which, as described below, is associated with the rotating shaft 8 of the fan wheel A. The supporting rod 13 is provided with a plate element 26 at the top portion thereof, which pivotally supports a pair of arms at pivot points 33. Said pair of supporting arms consist of an upper arm 29 and a lower arm 32, which are pivotally connected by pivots 33 with weights 31 interposed therebetween. The upper supporting arms 29 have semi-circular portions 29' provided with teeth 30. The teeth 30 of each semi-circular portion 29' mesh with each other so as to ensure rotations in opposite directions. The lower supporting arms 32 are pivotally connected to the sleeve 19. For this purpose, a sleeve 19 may be provided with a bracket 27, as illustrated in FIG. 2. Thus, the supporting arms 29 and 32 are secured between the plate element 26 and the sleeve 19, and are ready to be folded when the sleeve 19 is raised. The folding of the arms 29 and 32 will be facilitated by the meshing of the teeth 30 of the semi-circular portions 29'. In this manner, the supporting arms 29 and 32 are foldable like a pantograph. Above the opening of the pipe 1, a hood 24 is provided which communicates with the atmosphere.

As described above, the supporting rod 13 is associated with the rotating shaft 8 of the fan wheel A, in order to ensure an associated rotation when the motor 4 is started. In a preferred embodiment illustrated, a resilient element 12, for example, a rubber element, is fastened to the terminating end of the rotating shaft 8 by means of crossed pins 11, thereby ensuring a unitary rotation of the resilient element and the rotating shaft. The resilient element 12 has broken portions 12', and the supporting rod 13 is capped with a stand 14 at the extreme end thereof, said stand 14 having legs 14'. The supporting rod 13 is connected to the rotating shaft 8 with the legs 14' of the capped stand being fitted in the broken portions 12'. The stand 14 and the resilient element 12 are covered with a pair of coverage elements 15, said pair of coverage elements being fastened together by means of a bolt and nut 34. By virtue of the resiliency of the resilient element 12, the supporting rod 13 is allowed to swing around on the rotating shaft 8. This is particularly advantageous in ensuring a governed centrifugal action of the weights 31 when the supporting rod 13 is rotated in association with the rotating shaft 8.

The operation of the present invention is as follows: Depending on whether it is desired to take in air or exhaust air, the motor 4 is started in the appropriate direction, thereby causing the fan wheel A to rotate in the appropriate direction. With the rotation of the rotating shaft 8, the supporting rod 13 and therefore the supporting arms 29 and 32, are also rotated. The sleeve 19 also rotates, whereas the shutter 22 stands independent of the rotation of the sleeve, as is apparent from the foregoing description. In the course of the rotation of the supporting rod 13, the supporting arms 29 and 32 are subjected to a centrifugal force which is accelerated by the weights 31. In addition, the rotation of the supporting arms is maintained smooth by the weights and also by the resiliency of the element 12. The supporting arms 29 and 32 gradually begin to fold due to the centrifugal action, thereby enabling the sleeve 19 to rise in the upward direction. The folding of the supporting arms is helped by the meshing of the teeth 30 of the supporting arms. Thus, the shutter 22 resting on the sleeve 19 is caused to rise up under the guidance of the guiding rods 25, whereby an air passable gap is produced between the hood 24 and the opening in the pipe 1. The folded condition of the supporting arms is shown by the dotted lines in FIG. 2.

When the operation of the fan wheel A is stopped by de-energizing the motor 4, the folded arms are gradually unfolded to their original stretched condition, thereby causing the shutter 22 to be lowered which closes the opening of the pipe 1. During this stage of the operation, the weights 31 serve to make the downward movement of the shutter smooth and efficient. When the supporting arms are fully stretched, at their original position, it is preferred that they are bent slightly inward, that is, the weights 31 are oriented inward as indicated by the real lines in FIG. 2, thereby ensuring that the arms are locked. This is advantageous in that the shutter 22 is prevented from floating up under an unexpected draft passing through the pipe 1. However, the locked arms are readily released by the centrifugal action initiated by the revolution of the supporting rod 13. If the roof ventilator of the present invention is built with a tilt or a slant, one pair of the arms are more severely locked by the weight. However, in this situation, the meshed teeth 30 are particularly helpful in releasing the locked arms.

The free end of the supporting rod 13 extends in a relatively large space under the hood 24, and additionally, the root portion thereof is supported on the resilient element 12. This is helpful for the weights 31 to govern the rotating speed of the supporting rod 13. The movement of the shutter is maintained smooth with the aid of the meshed teeth, thereby creating no undesirable large noises. Otherwise, noises would be amplified due to resonance created under the hood 24. As state above, the shutter 22 is held at the periphery thereof by guiding rods 25, whereby the shutter is prevented from flapping whether the ventilator is in operation or not. As referred to above, the roof ventilator of the present invention can be built with a tilt or a slant, if required, and also it can be safely mounted in windy locations.

The invention being thus described, it will be obvious that the same may be varied in many ways. Such variations are not to be regarded as a departure from the spirit and scope of the invention, and all such modifications are intended to be included within the scope of the following claims.

We claim:

1. A roof ventilator adapted to be housed in a pipe provided with an opening therein which comprises, a substantially unitary shutter means adapted to extend across the opening in a pipe and to be raised above or lowered over such an opening, a supporting rod connected to a rotating shaft for rotatable disposition within such a pipe, a fan means to be housed in such a pipe below said shutter means and attached to said shaft, means for rotating said shaft and the fan associated therewith, said shutter means being supported on said supporting rod by two pairs of foldable arms, said foldable arms being disposed above said shutter means, each pair of arms being pivotally connected to each other and to a terminating top end portion of said supporting rod at one end and associated with the shutter means at the other end so that upon the rotation of the fan means a unitary upward movement of said pairs of foldable arms is achieved which lifts the shutter means above the end of a pipe.

2. The roof ventilator of claim 1, wherein the supporting rod is connected with the rotating shaft by a means which includes a resilient element.

3. The roof ventilator of claim 1, wherein the end portions of each pair of foldable arms which are pivotally connected to the top of the supporting rod are provided with opposing tooth portions, said tooth portions being placed into engaging relationship with each other so as to ensure the rotation of said toothed portions on a vertical plane in opposite directions and wherein a weight is disposed at the point where each pair of said arms are pivotally connected to each other.

4. The roof ventilator of claim 3, wherein when the two pairs of foldable arms are in a fully extended position each arm is bent slightly inward at the point where they are pivotally connected, thereby ensuring that the arms are locked in this position.

5. The roof ventilator of claim 3, wherein a plurality of guide rods extend upwardly from the terminating end portion of a pipe wall and said shutter means is provided with a corresponding number of apertures in the periphery thereof adapted to accomodate said guide rods.

6. A roof ventilator adapted to be housed in the opening of a pipe which comprises a shutter means adapted to extend across a pipe opening, a shaft disposed for rotatable disposition in such a pipe, said shaft extending through said shutter means and above and below said shutter means, fan means operatively attached to said shaft below the shutter means, motor means for rotating the shaft and fan means attached thereto, two pairs of foldable arms disposed above said shutter means, each pair of arms being pivotally connected to each other and to a terminating top end portion of the shaft at one end for rotation therewith and associated with the shutter means at the other end, the end portions of each pair of foldable arms which are connected to the top of the shaft being provided with opposing tooth portions, said tooth portions being in engaging relationship with each other so that upon the rotation of the fan, a unitary upward movement of said pairs of said foldable arms and said shutter means if achieved which causes said tooth portions of each of said pairs of foldable arms to rotate in a vertical plane and in opposite directions.

7. A roof ventilator housed in a pipe provided with an opening therein which comprises in combination; a substantially unitary shutter means extending across the opening in said pipe and positioned to be raised above or lowered over said opening, a supporting rod connected to a rotating shaft which is rotatably disposed within said pipe, a fan means housed in said pipe below said shutter means and attached to said shaft, means for rotating said shaft and said fan means associated therewith, said shutter means being supported on said supporting rod by two pairs of foldable arms, said foldable arms being disposed above said shutter means, each pair of arms being pivotally connected to each other and to a terminaling top end portion of said supporting rod at one end and associated with the shutter means at the other end so that upon the rotation of the fan means, a unitary upward movement of said pairs of foldable arms is achieved which lifts the shutter means above the end of the pipe; and hood means positioned above the opening of said pipe.

* * * * *